US005738688A

United States Patent [19]

De Lathauwer

[11] Patent Number: 5,738,688

[45] Date of Patent: Apr. 14, 1998

[54] PROCESS TO IMPROVE RESISTANCE TO STAINS ON FIBRES AND DERIVED PRODUCTS

[75] Inventor: Armand De Lathauwer, Aalst, Belgium

[73] Assignee: N. V. Denderland-Martin, Gijzegem, Belgium

[21] Appl. No.: 687,403

[22] PCT Filed: Jan. 25, 1995

[86] PCT No.: PCT/BE95/00006

§ 371 Date: Aug. 2, 1996

§ 102(e) Date: Aug. 2, 1996

[87] PCT Pub. No.: WO95/21955

PCT Pub. Date: Aug. 17, 1995

[30] Foreign Application Priority Data

Feb. 2, 1994 [BE] Belgium ..... 09400124

[51] Int. Cl.[6] ..... D06M 13/238; D06M 15/41

[52] U.S. Cl. ..... 8/115.56; 8/116.1; 8/116.4; 8/120; 8/127.6; 8/115.56; 8/115.54; 8/137; 8/552; 8/594; 8/595; 427/389; 427/389.9; 427/393.4; 442/93; 428/365

[58] Field of Search ..... 8/116.1, 116.4, 8/120, 127.6, 115.56, 115.54, 137, 552, 594, 595; 427/389, 389.9, 393.4; 428/267, 278, 224, 365; 442/93

[56] References Cited

U.S. PATENT DOCUMENTS

| | | |
|---|---|---|
| 2,342,823 | 2/1944 | Schlack . |
| 3,961,881 | 6/1976 | Sumner et al. . |
| 4,501,592 | 2/1985 | Ucci et al. . |
| 4,833,009 | 5/1989 | Marshall . |

FOREIGN PATENT DOCUMENTS

| | | |
|---|---|---|
| 864576 | 4/1941 | France . |
| 53 081 788 | 12/1976 | Japan . |
| 61-174485 | 8/1986 | Japan . |
| 2-197579 | 8/1990 | Japan . |

OTHER PUBLICATIONS

Chem. Abstracts, vol. 90, No. 4, 22 Jan. 1979, Abstract No. 24736d, Wada, Hideki, Prevention of staining of dyed silk yarns.

Database WPI, Section Ch, Week 8638, Derwent Publications Ltd., London, GB; Class A11, AN 86–247834, Aug. 1986.

*Primary Examiner*—Alan Diamond
*Attorney, Agent, or Firm*—Pollock, Vande Sande & Priddy

[57] ABSTRACT

The invention consists of a process to improve the resistance to stains on fibres, processed or not, finished or not on the basis of dyeable natural or synthetic fibres, in particular polyamide. According to the invention the fibres are treated with a solution containing tannic acid and a condensation product of a sulphonated phenol- or naphtol-derivate with an aldehyde. The treatment can be made before, during or after the dyeing process. The treatment is done in an acid medium.

22 Claims, No Drawings

PROCESS TO IMPROVE RESISTANCE TO STAINS ON FIBRES AND DERIVED PRODUCTS

This application is a 371 of PCT/BE95/00006 filed Jan. 25, 1995.

This invention relates to a process to improve the resistance to stains on dyeable natural and synthetic fibres and in particular polyamide fibres.

By "fibres" has to be understood, fibres or yarns whether greige (raw) or processed, unfinished or finished, bright as well as dull, thermofixed or not, in yarn form or processed to fabric, felt, knitwear, non-wovens, carpets, rugs, etc. To simplify matters, in this description fibres in which form whatsoever will be called "substrate".

Removal of stains, coloured or not, from a substrate, is still a very delicate problem, as there could remain traces or spots either by discoloration or coloration of the original substrate caused by the stain or by the detergents which affect the dyestuff of the substrate. This is especially the case for stains caused by products containing chlorine, oxidative bleaching agents, and stains containing persistent dyestuffs or pigments for instance present in coffee, tea, wine, fruit juices, inks . . .

The purpose of this invention is to propose a process by which the resistance of a coloured or uncoloured substrate against stains of any nature is considerably improved whilst at the same time also other improved characteristics are obtained such as an improved antistatic behaviour, resistance to products such as turpentine and white spirit as well as resistance to soiling, mildew and house-mite.

It is known (C.A. Vol. 97 (1982) 7.704 U) that tannin is used to fix dyestuff after the dyeing process. On the other hand it is also known from the swimwear industry, to treat coloured nylon fabric with extraction's of gallotannin to improve the colour fastness to chlorine. This was based on the fact that the additional treatment of coloured nylon fabric with gallotannin extraction's caused a migration of the dyes in the fibre whereby the gallotannin is fixed on the fibre. This provides a certain resistance to discoloration of the substrate by products containing chlorine. However this treatment has no known effect on coloured stains, and on stains caused by other oxidative bleaching agents.

On the other hand, it is known from the U.S. Pat. No. 4,501,591, to treat polyamide fibres after application of the dyestuff, with condensation products of sulphonated phenol- or naphtol-formaldehydes in presence of an alkalinemetal silicate. It has been shown that for polyamide fibres, this treatment provides resistance to colour stains and particularly effective for anionic dyes. This treatment has no effect whatsoever on chlorine stains and on stains of other oxidative bleaching agents.

In the cosmetic industry, there is an increasing use of strong oxidative bleaching agents, such as benzoylperoxyde. Resistance to stains caused by this type of products is unknown in the textile industry.

During extensive research in this field, it has now surprisingly been demonstrated that the resistance of coloured or uncoloured substrate to stains or to deterioration of the fibres caused by oxidative bleaching agents, is considerably improved when the substrate is treated with a solution containing tannic acid and a condensation product of a sulphonated phenol- or naphtol-derivate with an aldehyde.

It has also been found that this treatment is also very effective against stains caused by dyes of natural or synthetic origin of anionic, cationic, metalcomplex or disperse nature.

That the tannic acid would improve the discoloration caused by chlorine, could be expected by the man skilled in the art, but that treatment with the solution mentioned above would be more efficient than a normal tannic acid treatment, could not be predicted.

Furthermore, the resistance to coloured stains obtained by a treatment with a condensation product of a sulphonated phenol- or naphtol-formaldehyde is not only met by the treatment with the solution according to the invention, but is considerably improved.

The effectiveness of the solution containing both components (tannic acid and condensation product) is not only better than this of the separate components, but also provides a protection against a wide range of coloured stains for which the individual components were not effective.

The interaction of these two components increases the efficiency of the individual components and provides unexpected additional properties, such as protection against coloured stains of cationic, metalcomplex and disperse nature, and especially against stains caused by oxidative bleaching agents.

According to the invention, the substrate, in acid medium, is treated with a solution containing 1 to 6% (weight %) active component, consisting of 10 to 90%, preferably 40 to 80% tannic acid (tannic acid component) and 10 to 90%, preferably 20 to 60% condensation product of a sulphonated phenol- or naphtol-derivate with an aldehyde (sulphon component).

These concentrations and proportions are not critical, though it has been noticed that higher concentrations hardly influence the result but could cause a yellowing of the substrate.

The components will be preferably dissolved in water, though another medium such as alcohol, acetone, etc... is also possible.

According to a preferred embodiment of the invention, the substrate is treated during the dyeing process. The treatment can be inserted in a continuous as well as well as in a discontinuous dyeing process. When applied in a continuous dyeing process, the treatment can be done before as well as during or after the effective dyeing step. In a discontinuous dyeing process, posttreatment is preferred.

Tannic acid is a compound derived for several centuries from nutgalls and has a structure of polygalloylglucose or polygalloylquinic acid.

The term "tannic acid" as used in this description and claims should be understood in a broad sense, and covers products containing tannic acid, such as for instance gallotannin.

In fact tannic acid is a mixture of compounds consisting of a glucose-chain which is several times substituted with gallic acid or trihydroxy-3,4,5-benzoic-acid-l. Substitution can also be made with digallic acid or with trigallic acid.

Tannic acid e.g. contains nonagalloylglucose, a glucose-chain substituted 5 times with gallic acid, 4 times of which is digallic acid and the formula of which is the following:

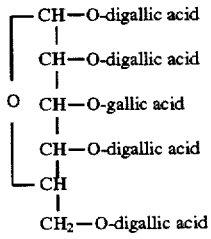

According to the invention, any commercial tannic acid can be used, though it is economical to use a tannic acid with a relatively high molecular weight. The molecular weight of the tannic acid will preferably be between 700 and 3500, though this range is not critical.

It has also been found that optimum results can be achieved when the tannic acid component consists of a mixture of a tannic acid with a relatively low MW and a tannic acid with a relatively high MW. So it has been shown that a mixture, consisting of a tannic acid with an average MW lower than 1000 and a tannic acid with an average MW higher than 1500, can give better results than tannic acid of exclusively 1500 MW.

The tannic acid component is preferably used in an aqueous solution. For the man skilled in the art, it will be clear that the water has preferably to be de-ironed and softened.

The solution to be applied will contain 10 to 60 g tannic acid per liter of water, preferably 15 to 25 g/l. To avoid oxidation of the solution, a small quantity of an aliphatic mono carboxylic acid with a boiling-point lower than 100° C., e.g. acetic acid, can be added.

To avoid oxidation of the substrate, it is also recommended to add a non volatile, non hygroscopic and preferably non corroding acid, as e.g. an aliphatic carboxylic acid such as citric acid or polyacrylic acids. It could also be economical to add a wetting agent, such as e.g. isopropanol.

The sulphonic component is a condensation product of a sulphonated phenol- or naphtol-derivate with an aldehyde. Such compounds contain at least a sulphonic group in acid and/or salt form, which is combined with at least a carbon atom of a phenol or naphtol group. The product can be synthezised by reaction of one of these compounds with an aldehyde e.g. formaldehyde. Some of these products and their preparation are described in the above mentioned U.S. Pat. No. 4,501,591. The sulphonic-component, in a concentration of 5 to 50 g/l, can be added to the solution containing the tannic acid component.

It can be advantageous to increase the molecular chain of the components for instance through cross-linking by adding to the solution or to the rinsing water a complexing agent, such as aluminium potassium sulphate or potassium antimonyl tartrate, or a compound reducing the solubility of the sulphon component, such as silicium dioxide gel, a magnesium or zirconium salt, . . . whereby the complexing agent can have a cross-linking effect on the tannic acid and the sulphon component.

The solution containing both components must preferably have a pH between 2,5 and 5, and eventually be adjusted by adding an acid for instance a sulfamic acid, formic acid, acetic acid . . . Strong mineral acids have to be avoided.

According to an embodiment of the invention, the substrate to be dyed, will first be treated with the mixture of both components according to the invention and afterwards cold dyed.

The expression "dyed or dyeing" as used in this description means any process by which dyes are applied on a substrate, such as dyeing, printing, spacing, spraying, etc...

The dyes to be applied are dissolved in water, eventually by heating, and afterwards adjusted to the right volume with cold water. The operation will preferably be done in an acid medium.

When applying the dyestuff in a continuous printing process, an acid-resisting thickening agent, such as an hydrocolloide, e.g. Xanthanegum, will preferably be added.

Dyestuffs suitable to be used when applying the mixture according to the invention, are in general acid as well as metalcomplex or disperse dyes. Basic dyestuffs are less suitable, due to the acid conditions.

In case basic dyes are used, it is recommended to apply the treatment according to the invention, as an additional treatment.

Also in a differential dyeing or cross dyeing process, when acid and basic dyes are used, it will be recommended to apply the treatment with the tannic acid- and sulphon-components as an additional operation after dyeing.

For the man skilled in the art, it is obvious to select dyestuffs which fit in the described process and do not cause any side-reactions with the applied reagentia and products.

A good preselection of dyestuffs will be made through obvious criteria. For the process to be followed, it can e.g. be useful to select dyestuffs with fast fixing properties.

Below, some dyestuffs that fit in very well in the frame of the invention, are mentioned as non restrictive examples. The dyestuffs are indicated with their corresponding colour index number as it is common practice.

- Acid Yellow 121, 219 and 230
- Acid Orange 116 and 156
- Acid Red 42, 243, 299 and 395
- Acid Blue 40, 113, 129 and 344
- Acid Black 172
- Mordant Orange 6
- Disperse Yellow 2
- Disperse Red 55.1 and 340
- Disperse Blue 7
- Basic Red 23 and 73
- Basic Yellow 45 and 63
- Basic Blue 45 and 129.

Other dyestuffs have also been tested with satisfactory results.

According to another embodiment of the invention, the solution of tannic acid-component and sulphon-component, can also be added directly to the dyebath, so that the substrate can simultaneously both be dyed and treated with the solution according to the invention.

In case of a continuous process, the substrate, after dyeing, is preferably steamed during a half to a few minutes with airfree saturated steam. After steaming, the coloured substrate is rinsed, preferably with cold water, at which a stabilizer can be added, preferably a non volatile, non hygroscopic, and non corroding acid, e.g. an aliphatic carboxylic acid, in a concentration e.g. between 0,5 to 5 g/l.

According to a further embodiment of the invention, the substrate can be dyed following the standard process, and at any time post-treated with the solution according to the invention. In this case the dyed substrate is treated with the solution containing both components, during a few minutes, preferably warmed up to a temperature of ±80° C. The treated substrate is then rinsed, steamed and dried following the normal process.

When applied in a discontinuous process, the substrate is preferably dyed according to normal dyeing procedures, and then posttreated in a bath with a solution of tannic acid- and sulphon-components. The bath containing the substrate is preferably gradually warmed up till ±80° C. Then the substrate is cooled, rinsed and dried.

It is clear that the improved characteristics can also be obtained by treating a substrate in a two step process, whereby in a first step one of the components (tannic acid-component or sulphon-component) is applied and in a second step the other component, whereby it can be possible to apply for instance the first step before and the second step after dyeing. Such an embodiment needs however an additional treatment.

When a substrate is treated according to one of these embodiments, an unknown resistance to oxidative bleaching agents and chlorine is noticed. Also an unknown resistance to colour stains of natural or synthetic origin containing anionic, cationic, metalcomplex or disperse dyestuffs, is achieved.

Stains of coffee at 70° C., kool-aid (highly coloured softdrink), wine, ink, etc., can easily be removed by wetting the stain with cold or lukewarm water, and dry dabbing.

An additional advantage of the process according to the invention is, that a coloured substrate shows a better resistance to products such as turpentine and white spirit, and an improved resistance to mildew and house-mite has been observed.

Tests have been executed with respect to light-fastness and washing-fastness, and showed that the process has no influence on the light fastness and a rather positive influence on the washing fastness.

The process and the various ways of applying it is described more in detail below, by way of following non restrictive examples:

EXAMPLE 1

A solution was prepared by dissolving 10 g tannic acid with a MW of 900 (Mijimoto commercial product) in 10 g/l tannic acid with a MW of 2000 (Mijimoto commercial product) in 1 l of soft water. To this, 25 ml of Alguard NS (Allied Colloids) (40% aqueous solution) was added. Then 2 g of a mixture of polyacrylic acids (Eulysine S BASF) and 5 ml acetic acid 80% was added as stabilizer, as well as 5 ml isopropanol as wetting agent. The pH of the solution was 2.5.

A piece of substrate (A) consisting of polyamide 6.6 in the form of spun yarns (as used in velvet) was soaked in this solution at room temperature and squeezed till an uptake equal to 100% substrate.

The wet substrate was printed over with Acid Yellow 230. To this end 1 g of dyestuff was dissolved in 0.1 l of warm water, then cold water was added to I 1. To this solution, 5 ml acetic acid 80% was added, until a pH of 3.5 was obtained. Finally, Xanthanegum Type Kelzan was added until the required viscosity was reached.

After that the substrate was printed, it was steamed with airfree saturated steam at 98° C. during 2 minutes, and then rinsed with cold water. At the rinsing water and/or the last rinsing bath, 2 g of a mixture of polyacrylic acids (Eulysine S) per liter of water was added. Then the substrate was dried at 100° C.

Comparative 1 a

A piece of substrate (B) from the same material as substrate (A) was dyed with the same dye solution after it has been moistened with an aqueous solution of acetic acid to which isopropanol was added, but without tannic acid or any condensation product of a sulphonated phenol- or naphtol-derivate with an aldehyde. The coloured substrate was steamed and rinsed in the same way as in example 1.

Comparative 1 b

A piece of substrate (C) from the same material as substrate (A) was dyed with the same dye solution after it has been treated with an aqueous solution to which 20 g/l tannic acid, as well as acetic acid and isopropanol was added, but not sulphonated condensation product. The coloured substrate was steamed and rinsed in the same way as in example 1.

Comparative 1 c

A piece of substrate (D) from the same material as substrate (A) was dyed with the same dye solution after it had been moistened with an aqueous solution containing Alguard NS and additives in the same concentration as in example I, but without adding tannic acid. The coloured substrate was steamed and rinsed in the same way as in example 1.

The substrates were subject to following tests:

Test 1: Benzoylperoxide test 1 cc of a skincare product, Mytolac (Richardson-Vicks), a commercial product containing 5% benzoylperoxide, was spotted on substrates A, B, C and D.

The stain was left to dry during 24 hours and then treated with cold water and dabbed dry.

From substrate A, the stain had completely disappeared and there were no traces of any discoloration left.

Substrates B and D were completely discoloured and an orange stain was left.

On substrate C, the stain had disappeared for about 70%, but showed a clear discoloration.

Test 2: Coffee test

A cylinder Ø 4 cm and 40 cm high was placed on the substrate. At the bottom of the cylinder, 10 ml of hot coffee at 70° C was injected, whilst on top of the cylinder a weight of 300 g was dropped to press the coffee into the substrate. This was left untouched during 24 hours.

After 24 hours, the coffee stain was dabbed with hot water (60° C.) and dried up with an absorbing tissue.

The stain on substrate A had completely disappeared.

On substrate B, the treatment had practically no effect on the stain which was only removed for 20%. A further treatment with household bleaching water containing 1 g/l active chlorine was needed to remove the stain. The chlorinated water left a clearly visible pale stain.

On substrate C, the stain was removed for the major part (80%), but a trace remained visible. A further treatment with household bleaching water containing 1 g/l active chlorine was needed to remove the stain. The chlorinated water left a slightly visible pale stain.

On substrate D, the stain was partly removed (±60%), but still well visible. A further treatment with household bleaching water containing 1 g/l active chlorine was needed to remove the stain. The chlorinated water left a clearly visible pale stain.

Test 3: Red wine test

With the same testing material as for the test mentioned above, 10 ml of red wine was brought on the substrate and left during 24 hours. Then the stain was treated with lukewarm water and dabbed dry.

The results were similar to these of the coffee test.

On substrate A, the stain was completely removed.

On substrate B, the stain remained visible for 70%.

On substrates C and D, the stain remained visible for 20% to 40%, but a further treatment with chlorinated water was needed, which left a pale stain.

Test 4: Kool-aid test

With the same testing material as for the test 2, a kool-aid stain was made on the substrate. The stain was made with a solution of 95 g/l kool-aid in tap water. After 24 hours, the stain was treated with cold water and dabbed dry.

On substrate A, the stain was completely removed.

On substrate B, the stain was still present for 90%.

On substrate C, the stain was still present for 80%.

On substrate D, the stain was almost completely removed.

Test 5: Chlorine test

With a pipette, 2 ml of a solution of respectively 1 g/l, 3 g/l and 10 g/l active chlorine was brought on the substrate. After 24 hours the stains were visually evaluated.

On substrate A, no discoloration was noticed for 1 g/l and 3 g/l. The solution of 10 g/l had caused a slight discoloration.

On substrate B, there was already a discoloration at 1 g/l.

On substrate C, no discoloration was noticed at 1 g/l and 3 g/l. The solution of 10 g/l caused a very clear discoloration.

On substrate D, there was already a discoloration at 1 g/l.

It has to be noticed, that a clear difference of discoloration was observed between substrate A and substrate C as of 7 g/l active chlorine.

On substrate B and D a complete discoloration was noticed at 3 g/l and with 10 g/l the substrate was affected.

This test proved that the treatment according to the invention not only protects the colour of the substrate against chlorine, but also gives a protection against the destruction of the substrate itself.

Test 6: Repeated stains

The coffee test (test 2) was repeated several times on the same spot of the substrate, and each time, the stain was treated with lukewarm water.

On substrate A, the coffee stain disappeared after five times (repeated stains) without leaving any trace. When the stain was made on the same spot for the sixth time, there was a slight discoloration visible after treatment with lukewarm water.

Test 7: Light fastness

A part of substrate A was exposed to light according to the DIN norm 54004, corresponding to ISO norm 105/BO2 (Xenontest).

The stain resistance test (test 2) as described above, was done on the exposed part after 24 hours of exposure to light, after 48 hours, after 72 hours . . . till after 240 hours of exposure.

The effectiveness of the stain removing treatment was compared with a non exposed part of substrate A. There was no difference noticed between the non exposed and the part exposed to light, even after 240 hours of exposure.

The same test was repeated on substrates A and B and the colour fastness of both substrates was compared after 240 hours of exposure. No colour difference was noticed. Therefore it can be stated that the treatment according to the invention has no influence on the colour fastness.

An additional test showed that for a substrate on the basis of polyamide dyed with a basic dyestuff the light fastness was substantially improved.

Test 8: Shampoo test

A part of substrate A was treated with a neutral carpet shampoo (Belgian Norm NBB: G62-014). The shampoo was mixed with water and the foam brought on the substrate with a brush. The shampoo was left to dry on the carpet and then removed with a vacuum cleaner.

After this treatment, test 2 as described above, was done on the cleaned part and compared to a part of substrate A not treated with shampoo. No substantial difference was noticed. This shampoo treatment did not affect the effectiveness of the stain-removing treatment.

This test was repeated five times, and showed that even after five shampoo treatments, the stain caused by hot coffee, still was completely removable without leaving any traces.

EXAMPLE 2

Example 1 was repeated but on a substrate (E) consisting of polyamide 6 in the form of a bulked continuous filament.

Comparative trials 1a, 1b and 1c were also repeated on substrates (F) (G) and (H), which were identical with substrate (E).

In comparative trial 2a a substrate (F) was treated as in example 2 but without the tannic acid component and without the sulphon component.

In comparative trial 2b a substrate (G) was treated as in example 2 but with the tannic acid component and without the sulphon component.

In comparative trial 2c a substrate (H) was treated as in example 2 but with the sulphon component and without the tannic acid component.

The tests 1 to 4 as given for example 1 were also repeated and the results are summarised in table 1 hereafter. For test 5 only the 3 g/l active chlorine was tested.

EXAMPLE 3

Example 1 was repeated but on a substrate (K) consisting of thermofixed polyamide 6 bulked continuous filament in cut pile.

Comparative trials 3a, 3b and 3c were made on substrates (L) (M) and (N) but:

- (L) without tannic acid component and without sulphon component
- (M) with tannic acid component and without sulphon component
- (N) without tannic acid component and with sulphon component.

The tests 1 to 5 as given for example 1 were also repeated.

EXAMPLE 4

In this example, the treatment according to the invention was applied in a continuous process but after that the substrate has been dyed.

A solution of tannic acid, Alguard NS, polyacrylic acid and acetic acid was prepared in concentrations and compositions as in example 1. The pH of the solution was 3.5.

This solution was poured over a piece of dyed polyamide 6 substrate (P) in the form of a textured continuous filament (as substrate E) and then steamed, rinsed and dried as in example 1.

Comparative trials 4a, 4b, 4c

Pieces of substrate (Q), (R), (S) from the same material as substrate (P) were post-treated with the same solution, but respectively:

- (Q) without tannic acid and without Alguard NS
- (R) without Alguard NS but with tannic acid
- (S) without tannic acid but with Alguard NS.

The tests 1 to 5 as given for example 1 were repeated.

EXAMPLE 5

In this example, the substrate was dyed in a discontinuous process, and afterwards treated with the solution according to the invention.

A piece of polyamide 6.6 substrate (T) in the form as substrate A (example 1) was dyed in the classic way with an acid dyestuff and rinsed. Thereafter the substrate was immersed in a bath containing a solution of tannic acid, Alguard NS, and polyacrylic acid in concentrations and with composition as in example 1.

The bath was gradually heated till 80° C. and kept at this temperature for about 20 minutes, then cooled, rinsed and dried.

Comparative trials 5a, 5b, 5c

Pieces of substrate (U), (V), (W) from the same material as substrate (T) were dyed in the same way, but respectively treated:

- (U) without tannic acid and without Alguard NS
- (V) without Alguard NS but with tannic acid
- (W) without tannic acid but with Alguard NS.

The tests 1 to 5 as given for example 1 were repeated.

TABLE 1

| Substrate | 1 | 2 | 3 | 4 | 5 |
|---|---|---|---|---|---|
| A | 0 | 100 | 100 | 100 | 0 |
| B | 100 | 20 | 30 | 10 | 100 |
| C | 30 | 80 | 80 | 20 | 0 |
| D | 100 | 60 | 60 | 95 | 100 |
| E | 0 | 100 | 100 | 100 | 0 |
| F | 100 | 20 | 30 | 30 | 100 |
| G | 25 | 95 | 95 | 60 | 0 |
| H | 100 | 30 | 30 | 100 | 100 |
| K | 0 | 100 | 100 | 100 | 10 |
| L | 100 | 20 | 30 | 30 | 100 |
| M | 35 | 70 | 90 | 50 | 30 |
| N | 100 | 30 | 30 | 100 | 100 |
| P | 0 | 100 | 100 | 100 | 0 |
| Q | 100 | 20 | 30 | 30 | 100 |
| R | 30 | 90 | 90 | 50 | 0 |
| S | 100 | 30 | 30 | 100 | 100 |
| T | 0 | 100 | 100 | 100 | 0 |
| U | 100 | 20 | 30 | 20 | 100 |
| V | 30 | 70 | 90 | 50 | 0 |
| W | 100 | 30 | 30 | 95 | 100 |

Test 1 Benzoylperoxide test % discoloration
Test 2 Coffee test % of stain disappeared
Test 3 Red wine test % of stain disappeared
Test 4 Kool-aid test % of stain disappeared
Test 5 Chlorine test % discoloration with 3 g active chlorine per liter.

It is obvious that the invention is not restricted to the described examples, but applies for any process by which a substrate is treated with a tannic acid solution (whereby tannic acid is to be understood in a broad sense, as described hereabove) and a solution containing a condensation product of a sulphonated phenol- or naphtol-derivate with an aldehyde. This treatment can be done before, during or after dyeing.

The examples were intentionally given with an identical mixture of tannic acid and Alguard NS, so that results could be better compared.

Additionally to the described tests, laboratory tests were made with coloured stains originating from different types of drinks and all results confirmed the improved resistance.

Furthermore tests were made with a tannic acid from other suppliers and did not show any difference, so that any available commercial product can be used. The molecular weight however is an important factor, and it can be preferred to use a mixture of tannic acid with a low MW, and a tannic acid with a high MW.

Tests were also carried out with different other condensation products of a sulphonated phenol- or naphtol- derivate with aldehydes, with equal results.

Instead of Alguard NS, different Mesitol (Bayer) products, different Stainmaster (Du Pont de Nemours) products, Erional KF (Ciba), Matexil FA-SNX (Zeneca), Resist 80-20 (Sandoz), Intratex N (Crompton & Knowles), etc., can also be used.

The examples were given with use of different polyamide substrates to demonstrate the results on the different characteristics of the fibres. As a matter of fact each polyamide has its own characteristics. So is PA 6 different from PA 6.6, is a PA with a continuous filament different from a PA with fibres in a spun yarn and that there are differences resulting from the manufacturing process, for instance PA thermofixed or not thermofixed.

The method is described and illustrated on the hand of polyamide fibres, but can be used for a large range of other substrates such as wool, silk, cotton, cellulosic substrate as well as polyester, polypropylene, polyacrylonitrile fibres, modified or not, in the form of polymers as well as in the form of copolymers or bicomponent synthetic fibres. Tests made on various fibres confirmed the positive results.

It is clear that the treatment with the solution containing tannic acid and a condensation product of a sulphonated phenol- or naphthol derivate with an aldehyde, can be combined with other compounds used in the field of the textile industry to seek for additional properties.

The concentrations, temperatures and reaction times were determined by the man skilled in the art, according to the used reagentia, products, dyestuffs, production process, type of substrate, etc...

Also the choice of stabilizer, wetting agent and other auxiliaries will be made by the man skilled in the art, who will take care that the selected auxiliaries do not cause any undesired reaction with the tannic acid component or the sulphon component or with any other product used.

I claim:

1. Method for improving the stain resistance of a substrate made out of dyed or dyeable natural or synthetic fibres, said method comprising contacting the substrate in acid medium with tannic acid and with sulphonated phenol- or naphthol-aldehyde condensation product, the amounts of tannic acid and sulphonated product each being in the range of 10 to 90 percent, based on the total weight of said tannic acid and sulphonated product, and producing improved stain resistance in said substrate through such contacting.

2. Method according to claim 1, wherein the total weight of said tannic acid and sulphonated product represents 1 to 6% by weight of said medium.

3. Method according to claim 1, wherein the amounts of tannic acid and sulphonated product are in the ranges of 40 to 80% and 20 to 60% respectively, based on the total weight of said tannic acid and sulphonated product.

4. Method according to claim 3, wherein the total weight of said tannic acid and sulphonated product represents 1 to 6% by weight of said medium.

5. Method according to claim 1, wherein the acid medium is an aqueous solution having a pH in the range of 2.5 to 5.

6. Method according to claim 1, 2, 3, 4 or 5 wherein the tannic acid has a molecular weight equal to or greater than 1500.

7. Method according to claim 1, 2, 3, 4 or 5 wherein the tannic acid is a mixture of tannic acid with a molecular weight lower than 1000 and tannic acid with a molecular weight higher than 1500.

8. Method according to claim 1, wherein the substrate is brought into contact with the tannic acid and sulphonated product before, during or after dyeing of the substrate.

9. Method according to claim 1, wherein the substrate is brought into contact with the tannic acid and sulphonated product during dyeing of the substrate.

10. Method according to claim 1, wherein the substrate is brought into contact with the tannic acid and sulphonated product after dyeing of the substrate.

11. Method according to claim 1 wherein the medium is an aqueous solution and contains a stabilizer in an amount sufficient to avoid oxidation of the substrate and the solution.

12. Method according to claim 1, wherein the tannic acid and sulphonated product are brought into contact with the substrate sequentially.

13. A substrate of natural or synthetic fibers having improved stain resistance as compared to that of the untreated substrate, said substrate having been (a) treated with tannic acid and sulfonated phenol- or naphthol-aldehyde condensation product, in amounts sufficient to improve the stain resistance of the substrate; and (b) colored by application of dyestuff prior to, during or after treatment of the substrate with said tannic acid and sulphonated product.

14. A substrate with improved stain resistance as compared to that of the untreated substrate, said substrate of improved stain resistance being a product of the process of treating a substrate made of dyed or dyeable natural or synthetic fibres, in acid medium, with tannic acid and with sulphonated phenol- or naphthol-aldehyde condensation product, the amounts of tannic acid and sulphonated product each being in the range of 10 to 90 percent, based on the total weight of said tannic acid and sulphonated product.

15. A substrate according to claim 13 or 14 which comprises polyamide fibre.

16. A substrate according to claim 13 or 14 which is in the form of carpet.

17. An improved method of cleaning a colored substrate, wherein the improvement comprises:

pretreating said colored substrate, in an acidic medium prior to the presence of a given stain on said substrate, with tannic acid and sulphonated phenol- or naphthol-aldehyde condensation product, the amounts of tannic acid and sulphonated product each being in the range of 10 to 90 percent based on the total weight of said tannic acid and sulphonated product; and cleaning said stain from the pretreated substrate.

18. Method according to claim 17 wherein said substrate is cleaned by application of water to the stain.

19. Method according to claim 17 or 18 wherein the stain is composed of a persistent dye or pigment selected from among coffee, tea, wine, fruit juice or ink.

20. A solution for improving the stain resistance of a substrate, said solution containing tannic acid and sulphonated phenol- or naphthol-aldehyde condensation product, the amounts of tannic acid and sulphonated product each being in the range of 10 to 90 percent, based on the total weight of said tannic acid and sulphonated product.

21. A solution according to claim 20 wherein the amount of tannic acid is in the range of 40–90%, based on the total weight of said tannic acid and sulphonated product.

22. Method for producing a colored substrate of natural or synthetic fibres having improved stain resistance, said method comprising (a) contacting the substrate with tannic acid and sulphonated phenol- or naphthol-aldehyde condensation product at a combined weight concentration of 1–6% in aqueous acid medium, the amounts of tannic acid and sulphonated product each being in the range of 10 to 90 percent, based on the total weight of said tannic acid and sulphonated product, the total of said amounts being sufficient to improve the stain resistance of the substrate, (b) coloring said substrate with dye applied during or after contacting said substrate with said tannic acid and sulphonated product, and (c) recovering a product of improved stain resistance as compared to a similarly dyed product not contacted with said tannic acid and sulphonated product.

* * * * *